United States Patent [19]

Ihas et al.

[11] Patent Number: 4,600,802

[45] Date of Patent: Jul. 15, 1986

[54] CRYOGENIC CURRENT LEAD AND METHOD

[75] Inventors: Gary G. Ihas, Gainesville, Fla.; Robert F. Berg, Columbia, Md.

[73] Assignee: University of Florida, Gainesville, Fla.

[21] Appl. No.: 631,790

[22] Filed: Jul. 17, 1984

[51] Int. Cl.[4] ..... F17C 3/00; H01B 7/34

[52] U.S. Cl. ..... 174/15 CA; 62/514 R

[58] Field of Search ..... 174/15 CA, 15 BH; 335/216; 62/55.5, 514 R

[56] References Cited

U.S. PATENT DOCUMENTS

| | | | |
|---|---|---|---|
| 3,286,014 | 11/1966 | Williams | 62/55.5 |
| 3,371,145 | 2/1968 | Camille, Jr. | 174/15 CA |
| 3,542,937 | 11/1970 | Dammann et al. | 174/15 CA |
| 3,695,057 | 10/1972 | Moisson-Franckhauser | 62/514 |
| 3,900,699 | 8/1975 | Penczynksi et al. | 174/15 CA X |
| 4,209,657 | 6/1980 | Inai et al. | 174/15 CA |
| 4,369,636 | 1/1983 | Purcell et al. | 335/216 X |
| 4,394,634 | 7/1983 | Vansant | 335/216 |
| 4,447,670 | 5/1984 | Eckels | 174/15 CA |
| 4,453,149 | 6/1984 | Rios | 174/15 CA |

*Primary Examiner*—Arthur T. Grimley
*Assistant Examiner*—Morris H. Nimmo
*Attorney, Agent, or Firm*—Dennis P. Clarke

[57] ABSTRACT

A cryostat current lead design uses a relatively high (i.e., at room temperature) thermal and electrical conductiveity first tube at its top to minimize joule heating. A relatively low thermal and electrical conductivity second tube is disposed below the first tube and thermally insulates the current lead to lesson the zero current loss. A superconductivity lead accomodating lower member is attached at the bottom of the second tube with strands of wire extending from the interior of the first tube to the interior of the lower member which preferably is a tube. Superconducting leads may be attached by lead-tin alloy (soft) solder at the outside of the lower member. The method of the present invention is the use of the current lead to provide electrical power to a device within the liquid helium bath of the cryostat. Preferably, the room temperature resistance of the lead is between 0.7 volts and 1.0 volts divided by the maximum current to be carried.

24 Claims, 5 Drawing Figures

CRYOGENIC CURRENT LEAD AND METHOD

This invention was made with Government support under DMR-80-06929 awarded by the National Science Foundation. The government has certain rights in this invention.

BACKGROUND OF THE INVENTION

The present invention relates to cryogenic current leads and associated methods.

The use of cryostats is well known in the art. Typically, such cryostats comprise a Dewar containing liquid helium. Such a liquid helium filled Dewar may use adiabatic demagnetization in order to realize temperatures close to absolute zero.

The extremely low temperatures of a cryostat may be used for realizing superconductivity, or otherwise investigating low temperature phenomena.

Associated with the building of many cryostats (especially adiabatic demagnetization refrigerators) is the construction of leads for conducting electrical current from a room temperature source to a large magnet or other load in the liquid helium bath. Since the thermal conductances of the cryostat itself (i.e., even without leads) and that of a lead capable of carrying 50 to 100 amps can be comparable, appropriate design of the current leads can result in the savings of several liters of liquid helium per day in order to minimize the cost of maintaining the cryostat at cryogenic temperatures.

Various previous attempts have been made to design and construct optimal current leads for cryostats. However, these previous efforts usually assume continuous use (i.e., 100% duty cycle) and tend to ignore additional parallel heat leaks to the liquid helium, the parallel heat leaks often being comparable to the heat leak of the current leads. Alternately, previous designs for low duty cycle use have employed removable leads or leads having a low conductivity section which can be slid in and out of the Dewar neck. However, these may not always be practical due to insufficient clearance over the cryostat in many cases. Additionally, and more importantly for millikelvin cryostats, heating may be introduced by the mechanical disturbance of the cryostat caused by its use. Finally, some published designs are impractical for most uses simply because of their complexity or their size (some designs take up most of the Dewar neck crossection).

Calculating the heat flow along a current lead into a helium dewar is difficult partly because the thermal and electrical conductivities $\lambda(T)$, $\rho(T)$ of metals are not simple functions of temperature, especially below 100 K. Simplifying the problem by assuming very simple forms for $\lambda(T)$ and $\rho(T)$ and ignoring aspects such as the temperature dependent viscosity of helium gas, nonideal heat exchange, and additional heat leaks have not enabled a strictly analytic solution to be found for design of a lead using only $\lambda$, $\rho$, and the cryostat dimensions. Although it is possible to design leads using numerical data for $\lambda(T)$ and $\rho(T)$, this may not be worth the trouble to an experimentalist desiring a quick means for building 100 A leads. Also, cryostat peculiarities such as thermal conductivity and gas convection patterns in the Dewar neck make such a detailed approach all the more questionable.

OBJECTS AND SUMMARY OF THE INVENTION

Accordingly, it is a primary object of the present invention to provide a new and improved cryogenic current lead and associated method.

It is a more specific object of the present invention to provide a cryogenic current lead which is especially well adapted to low duty cycle use with minimal joule heating during use and minimal heat conduction during zero current.

The above and other objects of the present invention which will become more apparent as the description proceeds are realized: An invention comprising a current lead operable to carry current between room temperature and a cryogenic region and operably cooled by passage of cold gas from the cryogenic region through the current lead, the current lead including: An elongate, relatively high thermal and electrical conductivity hollow first member having an upper end and a lower end and allowing passage of the cold gas therethrough; an elongate, relatively low thermal and electrical conductivity hollow second member fixed to the lower end of the first member and extending below the first member, the second member having an upper end and a lower end and allowing passage of the cold gas therethrough; and a relatively high thermal end electrical conductivity wire including a plurality of strands and having a bottom end attached to the inside of the first member, the wire extending down through the inside of the second member for cooling by passage of the cold gas and operable to carry current to at least one superconducting lead electrically connected to the wire adjacent the bottom of the wire; and wherein the first member is adapted to extend from outside of a cryogenic chamber to inside of a cryogenic chamber. The first member consists essentially of elemental metal and the wire consists essentially of elemental metal. The wire is at least 99.9% elemental metal. The current lead further includes: A superconducting lead accommodating third member fixed at the lower end of the second member and adapted for attachment of at least one superconducting lead to extend therebelow, the third member comprising relatively high electrical conductivity material and being operable to electrically connect the wire to at least one superconducting lead. The third member is hollow. The wire consists essentially of a member of the group comprising: copper or nickel; and the first member consists essentially of a member of the group comprising: copper or nickel. The second member consists essentially of stainless steel. The first, second and third members are all axially aligned tubes and the first member extends along at least 10% of the length of the current lead. The invention further comprises a cryostat having downwardly decreasing temperatures and a liquid coolant bath, and wherein the lower end of the first member is disposed below the 10° C. point in the cryostat. Preferably, the lower end of the first member is disposed at about the 0° C. point to as low as the 50° C. below zero point. The lower end of the second member is disposed within 10 cm of the top surface of the liquid coolant bath. The invention may further comprise at least one superconducting lead electrically connected to the wire and extending downwardly therefrom.

The method of the present invention comprises the steps of: inserting the current lead into the cryostat with downwardly decreasing temperatures and with the superconducting lead extending into a liquid coolant bath in the cryostat, the lower end of the first member disposed below 10° C.; and electrically connecting a power source to the first member to supply power to within the cryostat by way of the current lead. The power is supplied to within the cryostat with a current I greater than $\frac{1}{2}$ $I_{max}$, the maximum current, for less than 10% of the time during which the current lead is inserted and the maximum current times the room temperature resistance of the current lead is between 0.7 volts and 1.0 volts. The cryostat includes at least a top baffle and the lower end of the first member is disposed above the top baffle. The first and second members are axially aligned. The first member extends along at least 10% of the length of the current lead.

In the following a design criterion for leads using pure (unalloyed) metal conductors is presented, and a very simple lead fabrication technique is described. The performance of these leads, with simple operating instructions, is discussed with an emphasis on their use at low duty cycles in a large refrigerator. In the range from 20 to 100 A these leads have a specific helium evaporation rate as low as or lower than any other published examples.

Our approach is to employ a simple formula for lead design containing a single empirically determined constant. Optimization of the overall cryostat performance is achieved by adjusting the ratio of flows of the evolving helium gas past the cryostat baffles and through the magnet leads. In the appendix it is argued that for leads composed of a pure metal and designed to carry a maximum current $I_{max}$, the length to crossection ratio of the leads should be chosen to give a room temperature resistance R(300 K.) of the lead so that:

$$I_{max}R(300\ K.) = V_0 \quad (1)$$

where $V_0$ is independent of the lead material used. We have found that for low duty cycle use (say $I > (\frac{1}{2})I_{max}$ for less than 10% of the time) $V_0$ can be as high as 0.7 to 1.0 V. For continuous use, $V_0$ must generally be only about 0.3 to 0.5 V.

DETAILED DESCRIPTION

Figure 1:
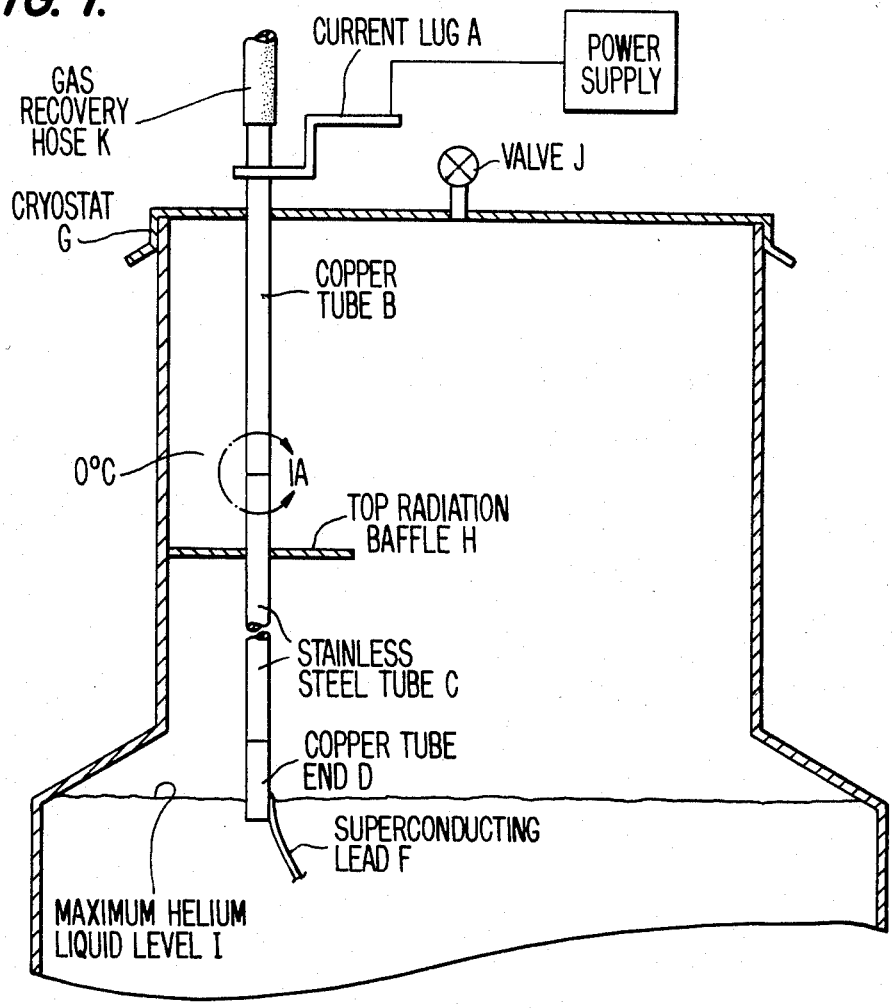
FIG. 1 and enlarged cross section view of FIG. 1A: Diagram of current lead of typical length with detail of copper-steel joint. A—current lug; B—$\frac{1}{4}$ inch od hard copper tube; C—$\frac{1}{4}$ inch od thin-walled stainless steel tube; D—thinned copper tube end piece to be attached to super conducting leads; E—several metal wires with their ends brazed to the inside surface of the copper tube; F—a superconducting lead which may be soft soldered onto the end piece D and comprise alternating layers of niobium-titanium and copper or other known superconducting lead structures; G—top of Dewar neck; H—top radiation baffle (only one baffle shown); I—maximum liquid helium level; J—valve for adjusting the relative amount of cooling gas flowing out of the cryostat to that flowing out of the current lead (parts D–E); K—gas recovery hose.
Figure 1A:
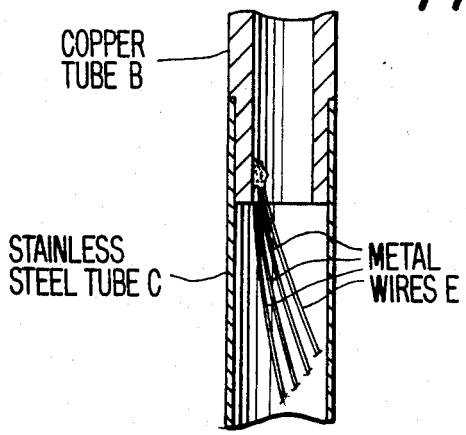

The current lead construction described here is shown schematically on FIG. 1. The lead is built to be easily installed through a 6.4 mm (0.25 inch) nylon compression fitting. The upper section is a 6.4 mm (0.25 inch) diameter hard copper water pipe whose end was turned and brazed into a longer length of 6.4 mm (0.25 inch) diameter thin-walled (about 0.3 mm) stainless steel tubing. The length of copper tubing is chosen to place the copper-steel junction at about the 0° C. point in the Dewar neck. This feature has a negligible effect on the zero-current helium evaporation rate but significantly reduces the dissipated power for large currents. This is because most of the electrical resistance is in the high temperature end of the lead.

The stainless steel tube section extends down to about the point of the maximum liquid helium bath level. It ends in a second short (2–3 cm) length of copper pipe also attached by brazing. At this point a superconducting lead with a normal shunt is attached by soft-soldering to the small copper section. Thus the leads can be easily removed or changed if necessary.

Most of the current is carried by parallel strands of conductors inside the stainless steel section. The ends of the conducting filaments are brazed to the inside walls of the copper pipes as shown in FIG. 1. The type of metal used is not very important as long as it is fairly pure (preferably 99.9% elemental metal with sufficient surface area for good heat exchange (a few $cm^2\ A^{-1}$ seems to work well). The use of the alloy is not recommended as the product $\lambda\rho/T$ for alloys can be two to four times higher than that for pure metals. The crossection area is chosen according to equation (1).

Two conducting materials which we have found to be satisfactory are flattened nickel wires and partially unravelled copper rope. The copper has the advantages of being less expensive and allowing a greater current density within the lead.

A commercial current lug can be brazed near the top end for easy attachment of power supply cables. A rubber hose is slipped over the top end to vent the cooling vapor to a helium recovery system.

The top tube or first member B preferably extends down at least 10% of the length of the current lead (comprised by B–E) such that it will be at a low temperature.

Proper use of gas-cooled current leads in a cryostat requires some means of controlling the relative impedances which limit the flow of gas past the cryostat baffles and through the leads such as valves or hose clamps. For the zero current state, one would think that the fraction of vapour that should be diverted through the leads would be the same as the ratio of the leads' thermal conductance to that of the entire cryostat. However, in practice, we have found that not so much gas need flow through the leads, probably because transverse conduction through the walls of the leads is sufficient to match the longitudinal heat flow from room temperature.

For operation at $I_{max}$, enough flow must be diverted through the leads to prevent undesirable self-heating. The safest course of action is to simply direct all gas flow through the leads. The boiloff due to the parallel thermal load of the cryostat thermal conductance then contributes significantly to cooling the leads. Minimization of the total boiloff rate during high current use of the leads is achieved by allowing a small fraction of the vapor to rise outside the leads to subdue the heat leak to the cryostat itself.

Figure 2:
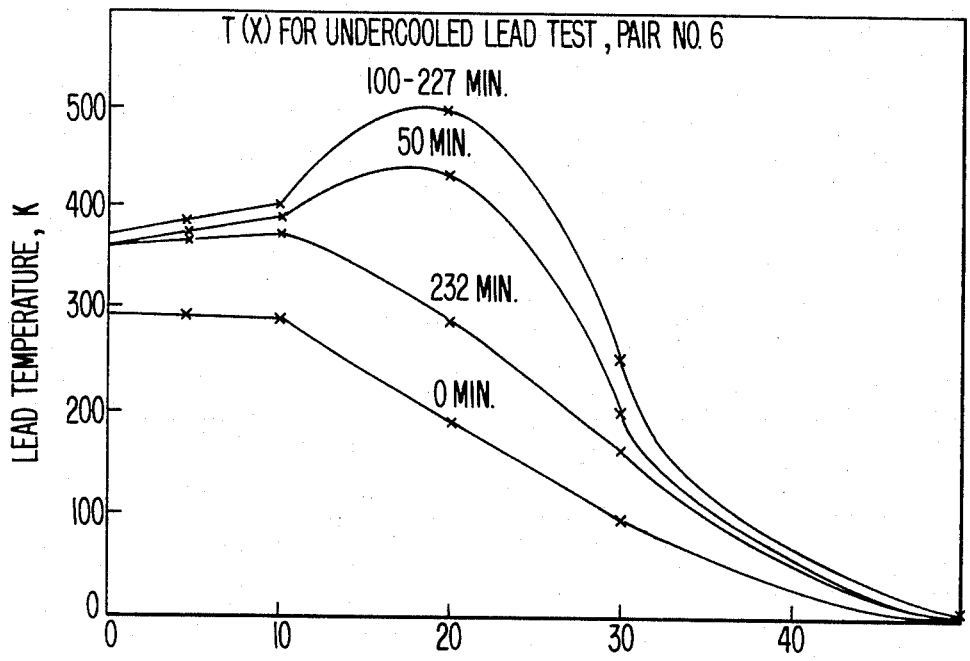
FIG. 2: Temperature distribution for undercooled leads in a large (4 mΩ) cryostat at various times after turning on a current of 75 A. At 227 min all of the helium vapor was directed through the leads to quickly cool them. The curves drawn through experimental points are merely suggested interpolations.

While leads designed for less than continuous use (having high $V_0$) will reduce the overall boiloff ofr low duty cycle use, a question of their safety might arise. To address this question, an example of a test of an undercooled lead is shown in FIG. 2. With less than 10% of the total boiloff diverted through the lead pair, the current in the pair (constructed with $V_0=0.96$ V) was quickly raised to and held at $I_{max}$(75 A). The resulting temperature distributions along one lead, as measured by a series of thermocouples, show that the lead continued to slowly warm until, after 100 min the fraction of gas flow through the leads was increased to prevent any further rise in temperature. After 2 h at this elevated temperature distribution, all vapor flow was forced through the leads which cooled to much lower temperatures in a few minutes.

Figure 3:
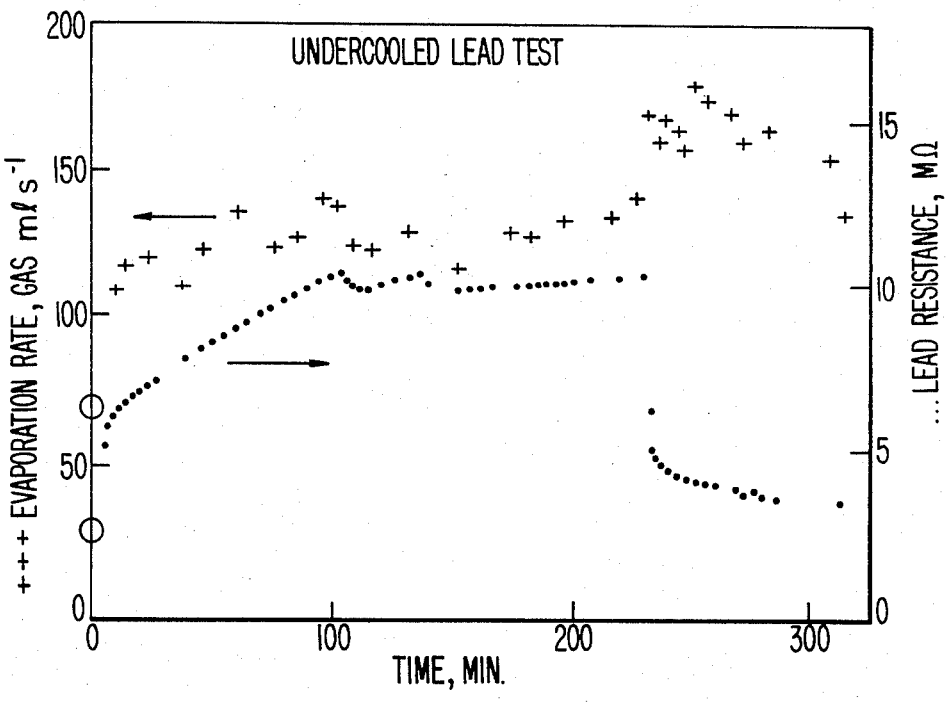
FIG. 3: Total cryostat and lead-induced evaporation rate and single lead resistance as a function of time for the undercooled leads of FIG. 2. Note the resistance drop and evaporation rate increase at 227 min. The zero-current values are circled on the left vertical axis.

The lead resistance and total boiloff rate are plotted in FIG. 3. Note that more than 100 W($2I^2R$) could be dissipated by the pair in the cryostat while only doubling the boiloff rate. Apparently, under these conditions, the gas surrounding the leads plays an important role—perhaps by conducting heat from the region of the temperature maximum to higher, cooler surfaces via convective cells. This conjecture is supported the observation that the gas temperature in the Dewar neck near the leads in the region of the temperature maximum stayed only 80° C. cooler than the leads themselves. When all of the helium vapor was forced through the leads, the maximum temperature became room temperature at the top of the lead and the power budget was more straightforward, with the joule heating matching the rate of enthalpy change of the vapor.

Figure 4:
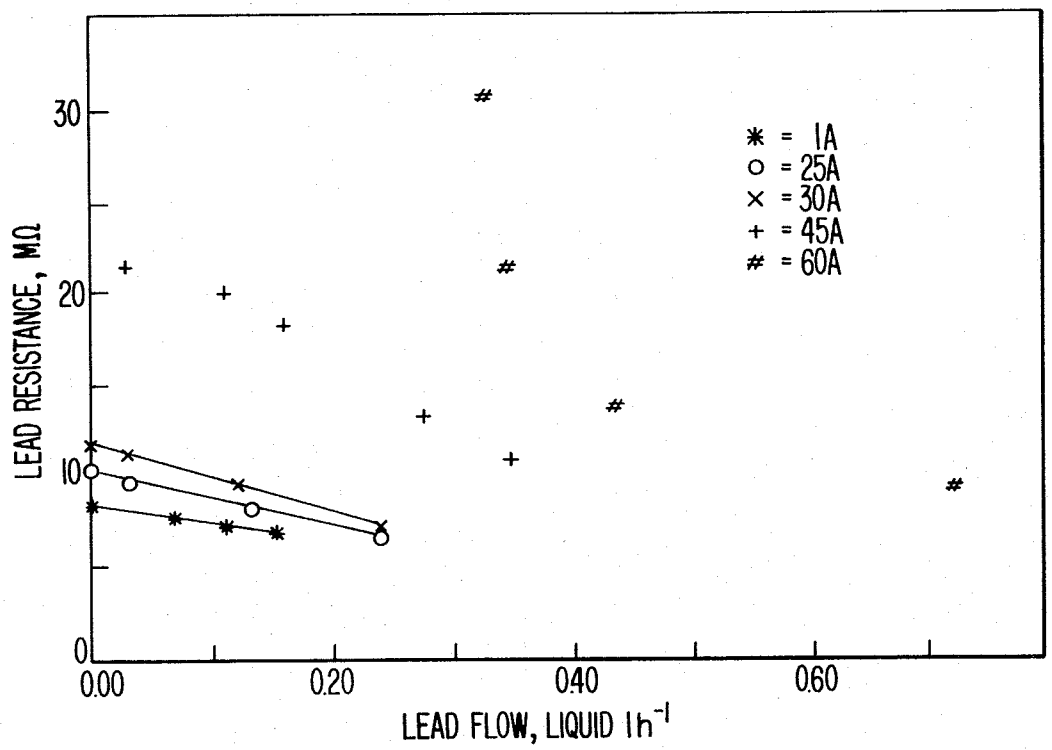
FIG. 4: Resistance of lead pair No. 3(designed for 65 A) as a function of gas flow through the lead for various currents. Straight line guides for the eye are given for the lowest three currents. Note that a non-zero lead gas flow is required to prevent lead distruction at 60 A.

We conclude the leads designed to reduce the total boil off for low duty cycle use (by having a higher $V_0$ than for continuous use) are safe though not foolproof when used in a conventional cryostat having metallic cooling baffles. Dangerous overheating takes one to two hours to occur whereas this condition can be reversed quickly. In the Dewar neck, no foam pieces which would tend to thermally decouple the leads and the cryostat should be employed. Monitoring the effect of gas flow through the leads on the lead temperature can be easily done by measuring the lead resistance while in use: prevention of overheating simply means keeping the lead resistance less than about three times the zero current value. FIG. 4 plots typical behavior of lead resistance versus gas flow through the leads for a pair designed for 65 A($V_0=0.77$ V). Note that dangerous undercooling is not even possible below 45 A.

Leads designed for low duty cycle applications reduce liquid helium losses by having a low thermal conductance in the zero current state. The importance of this heat leak can be estimated by measuring the room temperature electrical resistance of a pair of leads and that of the cryostat in which they are to be used. (For the three millikelvin cryostats at the University of Florida the resistances between the cryostat table and the 4 K flange are 2, 4 and 7 mΩ. Substitution of a pair of commercial leads designed for continuous use at 75 amp by a pair designed for intermittend use with 2.8 times higher resistance resulted in about a 30% savings in liquid helium use for the 4 mΩ cryostat).

Using the formula and design scheme we have described, in about 4 hours one can design and build a pair of leads useful for almost any cryogenic high current (20–100 A) use. Using the leads most efficiently should be a matter of monitoring the lead resistance while adjusting the fraction of flow through the leads to prevent their overheating.

Finally, in addition to their low cost and simple design, the fact that no soft solder is used in the construction of the leads is an advantage in that self destruction by melting is almost impossible.

The second member or C is hollow as are tubes B and D. This tube allows cooling gas to be forced past these wires, and can be made of anything which will hold up under thermal cycling and is a poor thermal conductor (e.g., fiber glass or resin bonded materials). We use stainless steel because a thin-wall tube is very strong (saving space), it will not burn or melt under any conditions which might occur in use and it is readily available. This particular construction tested requires that each lead be mounted in an electrically insulating fashion, using spacers (e.g., teflon rings) where they pass through the cryostat baffles, and non-conducting (e.g. nylon) compression fittings when they pass through the top of the cryostat. The conducting wires in the lower section can be any high purity, non-alloy metal, such as aluminum, silver, gold, tungsten, or nickel and copper as we tested. Nickel, for reasons mentioned in our paper, is probably the best, but easily available copper rope, which gives plenty of surface area, works great. A few $cm^2$/Ampere surface are is sufficient (A 0.01" diameter wire 30 cm long has a surface area of 2.4 $cm^2$, hence one of these fine wires per amp of maximum current is enough.)

Although in the present design a substantial portion (the top) of the lead was made out of very good electrical and thermal conductor, so that there is both a minimum of Joule heating in it and also so that it conducts a major portion of the heat produced in the current-carrying lead out of the cryostat, the overall electrical (and hence thermal) resistance of the lead is higher than that in other designs. This is done by increasing the length to area ratio (l/A) for the conducting strands in the lower portion of the lead. This reduces the heat leak (and hence the cryogen evaporation rate) when the leads are not in use. When carrying current, the major source of heat is resistive (joule) heating in the leads, but this is carried away by the gas flow through the lead and the top portion of the lead by conduction. We built a pair designed for 75 Amperes which had 2.8 times the resistance of a 75 Amp lead made in basic accord with U.S. Pat. No. 3,371,145 of Camille issued on Feb. 27, 1968. These gave striking savings in liquid helium use of 30%.

Our leads were designed for intermittent use (average current less than one tenth maximum current, e.g., full current for 1 hour, zero current for 9 hours. However, they can be used for hours (~4) without damage and with good efficiency, and at maximum current. They can be run well over maximum current (30% at least), and they require little or no attention in use no moving parts, no adjustments, etc. For maximum efficiency, one would adjust the gas flow through them as described above by valve J. However, for intermittent use, this is probably not worth the trouble.

These leads are to be used in any application where moderate (20–100 Amperes) currents need to be communicated to a cryogenic environment. They are particularly suited for intermittent use of high currents, such as occurs in component testing situations and persisting superconducting magnets. When used in Nuclear Magnetic Resonance Spectrometers and NMR imagers, they give the advantage of low helium consumption while allowing simple, fool-proof operation. This is also true for magnetic susceptometers and nuclear demagnetigation cryostat. Although we have not tested our leads over 100 Amps, this is certainly not the limit for our design. There is no need for any kind of special lead below 20 Amperes.

We show here that if perfect metal to vapor heat exchange is assumed and a simple form for the flow of heat along the current lead is used, the optimum length to crossection area ratio l/S can be simply characterized in terms of the current I to be carried and the minimum and maximum temperatures, $T_{cold}$ and $T_{hot}$.

For perfect heat exchange, the equation governing the temperature distribution T(x) on the lead is obtained by writing down the power contributions at the point x.

$$\frac{d}{dx}\left(S\lambda\frac{dT}{dx}\right)+\frac{I^2\rho}{S}-cM\frac{dT}{dx}=0 \tag{2}$$

where λ is the metal thermal conductivity, ρ is the metal electrical resistivity, M is the flow rate of vapor coolant, and c is the heat capacity of the vapor.

The flow of heat along the metallic conductor is $$Q=\lambda S\frac{dT}{dx} \tag{3}$$

At $T=T_{cold}$, $$Q=Q_{cold}=Mr \tag{4}$$

where r is the heat of vaporization of the liquid (no other heat leaks to the bath are considered here).

If the crossection S is constant, (2) can be rewritten in terms of the variable $$y=x/S$$

namely, $$\frac{dQ}{dy}+I^2\rho-\frac{cQ_{cold}}{r\lambda}Q=0 \tag{5}$$

Note that (5) has no explicit dependence on S, that is $$Q(l,S)=Q(l/S)$$

The variable y can be replaced by the variable T(y) if both integration constants for (2) are specified and $T_{hot}$ is the maximum temperature so that T(y) is single valued. Then using (3), (5) becomes $$Q\frac{dQ}{dT}+I^2\rho\lambda-\frac{cQ_{cold}}{r}Q=0 \tag{6}$$

The two integration constants are defined by specifying $T_{hot}$ and the heat flowing into the hot end $$Q_{hot}=0$$

This latter requirement is chosen as representing near-optimum conditions for continuous use. For intermittent use, optimization requires that the maximum lead temperature be higher than room temperature. Replacing the variable y by T(y) then means that the portion of lead between y(300 K.) and y($T_{hot}$) must be ignored. Since empirically this portion represents only 10% to 20% of the total lead (see FIG. 2), this analysis will then result in a slightly smaller l/S ratio than an exact numerical solution would give. Also note that $Q_{hot}=0$ at y($T_{hot}$).

Equation (6) determines Q(T,I) in terms of $T_{cold}$, $T_{hot}$, $Q_{hot}$, and the functions ρ(ρ) and (T). Now if we assume that the dependence of Q on the current is $$Q(T,I)=f(I)q(T) \tag{7}$$

then (6) becomes $$[f(I)]^2\left[\frac{cq(T_c)}{r}q(T)-q(T)\frac{dq(T)}{dT}\right]=I^2\rho(T)\lambda(T) \tag{8}$$

Thus $$Q(T,I)=Iq(T) \tag{9}$$

Using the form of (9) in (3) and integrating to get the lead length gives $$\int_{T_{cold}}^{T_{hot}}\frac{\lambda(T)dT}{Q(T)}=\int_0^l\frac{dx}{S} \tag{10}$$

or $$\frac{Il}{S}=\int_{T_{cold}}^{T_{hot}}\frac{\lambda(T)}{q(T)}dT$$

which is a constant, depending only on the type of metal used. If we approximate the thermal conductance by $$\lambda(T)\simeq\frac{L}{\rho(300)\alpha(T)} \tag{12}$$

where L is the Lorenz constant, ρ(300) is the metal's room temperature resistivity, and α(T) is the same function for all pure metals, then, for a given allowed $T_{hot}$, the lead resistance times the current to be carried is a constant.

$$IR(300)=\frac{Il\rho(300)}{S}=V_0 \tag{13}$$

Although various specifics have been described herein, these are for illustrative purposes only. Various modifications will be apparent to those of ordinary skill in the art. Accordingly, the scope of the present invention should be determined by reference to the claims appended hereto.

What is claimed is:

1. A current lead for carrying current between room temperature and a cryogenic region and cooled by passage of cold gas from the cryogenic region through said current lead including:

(a) an elongate relatively high thermal and electrically conductive hollow first member having an upper end and a lower end and allowing passage of the cold gas therethrough;

(b) an elongate relatively low thermal and electrically conductive hollow second member fixed to said lower end of said first member and extending below said first member, said second member having an upper end and a lower end and allowing passage of the cold gas therethrough; and (c) relatively high thermal and electrically conductive wire including a plurality of strands and having a top end attached to the inside of said first member, said wire extending down through the inside of said second member for cooling by passage of the cold gas and adaptable to carry current to at least one superconducting lead electrically connected to said wire adjacent said bottom of said wire; and wherein said first member is adapted to extend from outside of a cryogenic chamber to inside of a cryogenic chamber.

2. The current lead of claim 1, wherein said first member consists essentially of elemental metal and said wire consists essentially of elemental metal.

3. The current lead of claim 2 wherein said wire is at least 99.9% elemental metal.

4. The current lead of claim 1 wherein said current lead includes:

(d) a third member fixed at said lower end of said second member and adapted for attachment of at least one superconducting lead to extend therebelow, said third member comprising relatively high electrically conductive material and being adapted to electrically connect said wire to at least one superconducting lead.

5. The current lead of claim 4 wherein said wire consists essentially of elemental metal.

6. The current lead of claim 5 wherein said first member consists essentially of elemental metal.

7. The current lead of claim 6 wherein said third member is hollow.

8. The current lead of claim 7 wherein said wire consists essentially of copper or nickel; and said first member consists essentially of copper or nickel.

9. The current lead of claim 8 wherein said second member consists essentially of stainless steel.

10. The current lead of claim 4 wherein said first, second and third members are all axially aligned tubes and said first member extends along at least 10% of the length of said current lead.

11. A current lead for carrying electrical current between room temperature and a cryogenic region containing liquid helium coolant, wherein said lead is cooled by the passage of cold vapor from said coolant through said lead and including:

(a) an elongated, tubular first member adapted to extend from room temperature into the upper portion of said cryogenic region and having an upper end, a lower end, and an inside;

(b) an elongated, tubular second member having an inside, a lower end, and an upper end which is joined to the lower end of said first member, said second member extending below said first member;

(c) an elongated, tubular third member having an inside, a lower end, and an upper end which is joined to the lower end of said second member, said third member extending below said second member;

(d) a plurality of wires having upper ends and lower ends and contained at least partially within said second member, said upper ends of said plurality of wires attached to the inside of said first member and said lower ends of said plurality of wires attached to the inside of said third member.

12. The current lead as defined in claim 11 wherein said first and third members consist essentially of an elemental metal having a relatively high electrical conductivity and said plurality of wires are composed of metal which is at least 99.9% elementally pure and which has a relatively high electrical conductivity.

13. The current lead as defined in claim 11 wherein said second member is composed of a relatively low thermal conductivity material.

14. The current lead as defined in claim 11 wherein said first, second, and third members are hollow and allow the passage of said coolant vapor through said lead from the cryogenic region to room temperature.

15. The combination of a current lead for carrying current between room temperature and a cryogenic region and cooled by passage of cold gas from the cryogenic region through said current lead including:

(a) an elongate relatively high thermal and electrically conductive hollow first member having an upper end and a lower end and allowing passage of the cold gas therethrough;

(b) an elongate relatively low thermal and electrically conductive hollow second member fixed to said lower end of said first member and extending below said first member, said second member having an upper end and a lower end and allowing passage of the cold gas therethrough; and (c) relatively high thermal and electrically conductive wire including a plurality of strands and having a top end attached to the inside of said first member, said wire extending down through the inside of said second member for cooling by passage of the cold gas and adaptable to carry current to at least one superconducting lead electrically connected to said wire adjacent said bottom of said wire; and a cryostat having downwardly decreasing temperatures and a liquid coolant bath, and wherein said lower end of said first member is disposed at below 10° C. and wherein said first member extends from outside of said cryostat to inside of said cryostat.

16. The combination of claim 15 wherein said lower end of said second member is disposed within 10 cm of the top surface of the liquid coolant bath.

17. The combination of claim 16 wherein said first member consists essentially of elemental metal and said wire consists essentially of elemental metal.

18. The combination of claim 16 further comprising at least one superconducting lead electrically connected to said wire and extending downwardly therefrom.

19. The combination of a current lead for carrying electrical current between room temperature and a cryogenic region containing liquid helium coolant, wherein said lead is cooled by the passage of cold vapor from said coolant through said lead and including:

(a) an elongate, tubular first member adapted to extend from room temperature into the upper portion of said cryogenic region and having an upper end, a lower end, and an inside;

(b) an elongate, tubular second member having an inside, a lower end, and an upper end which is joined to the lower end of said first member, said second member extending below said first member;

(c) an elongate, tubular third member having an inside, a lower end, and an upper end which is joined to the lower end of said second member, said third member extending below said second member;

(d) a plurality of wires having upper ends and lower ends and contained at least partially within said second member, said upper ends of said plurality of wires attached to the inside of said first member and said lower ends of said plurality of wires attached to the inside of said third member; and a cryogenic container having downwardly decreasing temperature and a liquid coolant bath, wherein said first member comprises at least 10% of the total length of said lead and the junction between said first and second members is disposed between −50° C. and +10° C. points of said cryogenic container.

20. The combination as defined in claim 9 wherein said third member is from 2 to 3 centimeters long and said lower end of said second member is within 10 centimeters of a maximum level of said liquid coolant and is adapted for the attachment of a superconducting wire to carry current.

21. A method of using in combination a cryostat having downwardly decreasing temperatures and a liquid coolant bath and a current lead, said current lead including:

(a) an elongate relatively high thermal and electrically conductive hollow first member having an upper end and a lower end and allowing passage of the cold gas therethrough;

(b) an elongate relatively low thermal and electrically conductive hollow second member fixed to said lower end of said first member and extending below said first member, said second member having an upper end and a lower end and allowing passage of the cold gas therethrough; and (c) relatively high thermal and electrically conductive wire including a plurality of strands and having a top end attached to the inside of said first member, said wire extending down through the inside of said second member for cooling by passage of the cold gas and adaptable to carry current to at least one superconducting lead electrically connected to said wire adjacent said bottom of said wire; and wherein said first member is adapted to extend from outside of a cryogenic chamber to inside of a cryogenic chamber; comprising the steps of:

inserting said current lead into a cryostat with downwardly decreasing temperatures and with said superconducting lead extending into a liquid coolant bath in said cryostat, said lower end of said first member disposed below 10° C. in the cryostat; and electrically connecting a power source to said first member to supply power to within said cryostat by way of said current lead.

22. The method of claim 21 further comprising the step of supplying power to within said cryostat with a current I greater than $\frac{1}{2}$ I max, the maximum current, for less than 10% of the time during which the current lead is inserted in said cryostat and wherein the room-temperature resistance of the lead is between 0.7 and 1.0 volt divided by the maximum current to be carried thereby.

23. A method of using a current lead to carry electrical current between room temperature and a cryogenic region with downwardly decreasing temperatures and coolant, the current lead including:

(a) an elongated, tubular first member adapted to extend from room temperature into the upper portion of a cryogenic region and having an upper end, a lower end, and an inside;

(b) an elongated, tubular second member having an inside, a lower end, and an upper end which is joined to the lower end of said first member, said second member extending below said first member;

(c) an elongated, tubular third member having an inside, a lower end, and an upper end which is joined to the lower end of said second member, said third member extending below said second member;

(d) plurality of wires having upper ends and lower ends and contained at least partially within said second member, said upper ends of said plurality of wires attached to the inside of said first member and said lower ends of said plurality of wires attached to the inside of said third member;

the steps comprising:

inserting said current lead into a cryogenic region; and electrically connecting a power source to said first member to supply current to within said cryogenic region, said current being supplied greater than one-half of a maximum current $I_{max}$ for less than 10% of the time during which the lead is used in said cryogenic region.

24. The method of claim 23 wherein said current lead has a room temperature resistance and said maximum current, $I_{max}$, when multiplied by said room temperature resistance of said current lead is within the range of from 0.7 to 1.0 volt.

* * * * *

UNITED STATES PATENT AND TRADEMARK OFFICE

CERTIFICATE OF CORRECTION

PATENT NO. : 4,600,802

DATED : July 15, 1986

INVENTOR(S) : Gary G. Ihas; Robert F. Berg

It is certified that error appears in the above-identified patent and that said Letters Patent is hereby corrected as shown below:

Claim 20, line 1, "claim 9" should be --claim 19--.

Abstract: Line 2, "conductiveity" should be --conductivity--;

Signed and Sealed this

Eighteenth Day of November, 1986

*Attest:*

DONALD J. QUIGG

*Attesting Officer* *Commissioner of Patents and Trademarks*